United States Patent [19]

Franz et al.

[11] Patent Number: 4,860,630

[45] Date of Patent: Aug. 29, 1989

[54] MANUAL FOR ELECTRONIC ORGANS AND THE LIKE

[75] Inventors: Reinhard Franz, Tulpenstrasse 15, D-5401 Emmelshausen; Walfired Dost, Koblenz, both of Fed. Rep. of Germany

[73] Assignee: Reinhard Franz, Emmelshausen, Fed. Rep. of Germany

[21] Appl. No.: 129,659

[22] Filed: Dec. 7, 1987

[30] Foreign Application Priority Data

Dec. 6, 1986 [DE] Fed. Rep. of Germany ..... 3641813

[51] Int. Cl.[4] ..... G10C 3/16

[52] U.S. Cl. ..... 84/439

[58] Field of Search ..... 84/433, 439, 440, 467

[56] References Cited

U.S. PATENT DOCUMENTS

| | | | |
|---|---|---|---|
| 527,504 | 10/1894 | Nisley | 84/467 |
| 3,903,780 | 9/1975 | Aliprandi | 84/433 |
| 4,375,179 | 3/1983 | Schwartz et al. | 84/439 |
| 4,723,471 | 2/1988 | Sugimoto | 84/439 |

FOREIGN PATENT DOCUMENTS

| | | | |
|---|---|---|---|
| 19728 | 2/1979 | Japan | 84/433 |
| 19729 | 2/1979 | Japan | 84/433 |

*Primary Examiner*—Lawrence R. Franklin

*Attorney, Agent, or Firm*—Peter K. Kontler

[57] ABSTRACT

A manual for an electronic organ wherein the depression of keys takes place against resistance similar to that encountered on depression of piano keys. Thus, each key of the manual at first offers a pronounced resistance and thereupon a greatly reduced resistance to depression. Pusher is pivotably mounted on the key and cooperates with a convex cam face on a pivotable reaction lever such that the key must abruptly pivot the lever from one toward another end position during the initial stage of depression but the pusher is free to slide relative to the cam face in response to further depression of the key. The lever has a first arm which pivots the pusher relative to the cam face in response to pivoting of the lever from the one end position to thus reduce the force which the pusher can transmit to the lever, and the lever further comprises a second arm which carries a weight tending to pivot the lever back to its one end position. The lever can be arrested in a position out of reach of the pusher so that the key can be depressed solely against the opposition of a spring as in a standard manual. The cam face slopes away from the path of movement of the tip of the pusher in response to depression of the key to thereby further ensure that the resistance which the key encounters to depression decreases as the key continues to move away from its non-depressed position.

24 Claims, 4 Drawing Sheets

MANUAL FOR ELECTRONIC ORGANS AND THE LIKE

BACKGROUND OF THE INVENTION

The invention relates to improvements in manuals for electronic organs and analogous musical instruments. More particularly, the invention relates to improvements in manuals wherein selected keys are depressible about substantially horizontal axes against the opposition of springs or like yieldable means and wherein such depression involves a greater effort during the initial stage and a less pronounced effort during the next-following stage or stages of depression.

When the key of a piano is depressed, the player must exert a force which suffices to overcome the inertia of the associated hammer and certain other movable parts of the corresponding action. Moreover, the player senses a dynamic sliding of such movable parts relative to each other. Many electronic organs and analogous musical instruments have manuals which are designed in such a way that each key must be depressed against the opposition of a spring which offers a fixed resistance to depression and returns the key to its non-depressed position as soon as the application of finger pressure upon the key is terminated. Thus, the nature of resistance which is offered by the keys of the manual in an organ is quite different from the nature of resistance which is offered by piano keys. Consequently, it invariably requires a certain period of time for a piano player to become accustomed to the touch of keys in the manual of an electronic organ and vice versa.

German Auslegeschrift No. 24 26 106 of Aliprandi discloses a manual for electronic organs which is designed to produce a so-called piano effect, i.e., whose manipulation creates the impression of depressing the keys of a piano. To this end, Aliprandi proposes to place a pivotable reaction lever adjacent each key of the manual and to provide each key with a rigid, rotary or elastic pusher which can pivot the reaction lever in response to depression of the key. The lever has a cam face which is designed in such a way that the lever initially offers a rather pronounced resistance to pivoting from its starting or idle position but such resistance decreases as the depression of the respective key progresses. The lever is biased by a torsion spring so that it normally assumes its starting position and reassumes such position as soon as the depression of the corresponding key is terminated. The arrangement is such that only one component of the force which is required to depress a selected key is used to pivot the associated reaction lever from its starting position. Moreover, the mass of the reaction lever is small or very small, especially when compared with the mass of parts which must be displaced in response to the depression of a piano key. Lack of mass is compensated for by the utilization of strong springs which bias the reaction levers to their starting positions; such strong springs contribute to the overall cost of the manual. Another drawback of the manual of Aliprandi is that the reaction force of each lever is independent of the acceleration (change of velocity) of the respective key during movement of the key from the non-depressed toward the depressed position.

OBJECTS AND SUMMARY OF THE INVENTION

An object of the invention is to provide a manual which can be used in electronic organs and analogous instruments and wherein the sensation which is created in response to depression of keys matches or very closely approximates the sensation which is created by manipulating the keys of a piano.

Another object of the invention is to provide a manual wherein the dynamic behavior of keys closely resembles that of keys in a standard piano.

A further object of the invention is to provide novel and improved actions for use in the manual of an electronic organ or an analogous musical instrument.

An additional object of the invention is to provide novel and improved reaction levers and novel and improved means for moving the reaction levers in the above outlined manual.

Still another object of the invention is to provide the manual with novel and improved means for facilitating adjustment of reaction forces which are generated in response to depression of keys and with novel and improved means for selecting the end positions of the reaction levers.

A further object of the invention is to provide a novel and improved method of varying the dynamic behavior of keys in the above outlined manual.

Another object of the invention is to provide a musical instrument which embodies the above outlined manual.

A further object of the invention is to provide novel and improved means for controlling friction between the keys and the reaction levers of the above outlined manual.

The invention is embodied in a manual which is designed for use in an electronic organ or a like musical instrument and is operated with piano effect, i.e., the resistance which a key of the manual offers to depression is greater during the initial stage than during the next-following stage or stages of depression of the key. The manual comprises a plurality of keys each of which is depressible to thereby pivot about a first substantially horizontal axis, and a plurality of additional components for each key. Such additional components include a coil spring and/or other suitable means for yieldably opposing depression of the respective key and for restoring the respective key to non-depressed position as soon as the application of a depressing force is terminated, and a reaction member which is adjacent the respective key and is pivotable about a second substantially horizontal axis between first and second end positions. Each reaction member preferably constitutes a lever which has a first arm at one side of the respective second axis, a second arm at the other side of the respective second axis, an arcuate cam face, and means for biasing the reaction member to one of its end positions. The aforementioned components further include means for pivoting the respective reaction member from the one end position toward the other end position in response to depression of the corresponding key including a pusher which is pivotable with and is movable relative to the respective key and has a portion abutting the cam face of the associated reaction member in the one end position of the reaction member and in undepressed position of the respective key. The aforementioned portion of each pusher is located at a first distance and each biasing means is located at a greater second distance from the respective second axis in the one end position of the corresponding reaction member. The aforementioned portion of each pusher is arranged to move along a predetermined path in response to depression of the respective key, and each cam face slopes away from the respective path so that each pusher pivots the associated reaction member from the one end position with a first force during the initial stage and with a lesser second force during the next-following stage or stages of depression of the corresponding key. One arm of each reaction member is arranged to move the respective pusher relative to the corresponding key in response to depression of the key to thereby induce the aforementioned portion of the corresponding pusher to move along its path.

Each biasing means can comprise a weight which is provided on the other arm of the respective reaction member and has a center of gravity. Each first distance is preferably a small or minute fraction of the distance of the center of gravity o the corresponding weight from the respective second axis.

The one arm of each reaction member preferably abuts one side of the respective pusher in the one end position of the reaction member.

The aforementioned components can comprise means for pivotally connecting each pusher to its key so that the pushers are pivotable about third substantially horizontal axes. All of the axes are or can be at least substantially parallel to each other.

Still further, the aforementioned components can include means for yieldably urging the reaction members toward their other end positions with a variable force and against the opposition of the respective biasing means. As mentioned above, each biasing means can comprise a weight on the other arm of the respective reaction member, and each urging means can comprise a third arm on the respective reaction member and a second weight which is mounted on the third arm for movement between a plurality of positions at different distances from the respective second axis.

The other arm of each reaction member can include a cushion or pad which engages the aforementioned portion of the respective pusher in an intermediate position of the reaction member close to the other end position.

The aforementioned portion of each pusher has a second face which engages the cam face of the respective reaction member in the one end position of the reaction member. At least one of these faces preferably has a low coefficient of friction, i.e., the material which defines the one face is preferably selected in such a way that the one face offers little resistance to sliding movement relative to the other face and vice versa. Alternatively, or in addition to such design, one of the two faces can constitute the peripheral surface of a roller or an analogous rotary body which is provided on the respective pusher or on the respective reaction member to further reduce friction between the two faces, at least during the next-following stage of depression of the respective key. Still further, at least one face of each pair of cooperating faces can be defined by a cushion (i.e., by a cushion provided on the aforementioned portion of the respective pusher and/or on the respective reaction member).

The aforementioned components can further include first and second cushions against which the respective reaction member abuts in its first and second end positions. At least one of these cushions is preferably adjustable to thereby alter the extent of movability of the respective reaction member between its first and second end positions. The one cushion is preferably that cushion against which the reaction member abuts in its one end position (in undepressed position of the respective key).

The other arm of each reaction member can include first and second sections and means for articulately connecting the sections to each other. Each connecting means can comprise a hinge defining a fourth axis which is parallel to the respective first and second axes. The first section is or can be rigid with the one arm of the respective reaction member and the second section is pivotable relative to the first section about the respective fourth axis. Each biasing means is preferably provided on the second section of the respective other arm, and each other arm preferably comprises means for arresting the second section in a selected angular position relative to the respective first section. The hinges can comprise flexible webs which are integral with the respective first and second sections. The first and second sections of each other arm can be provided with sockets which are adjacent the respective webs. Each arresting means can comprise a threaded fastener which serves to maintain the respective sockets in predetermined positions relative to each other. The other arm of each reaction member is normally elongated and the sockets of the sections preferably extend transversely of the respective other arm.

The aforementioned components preferably further comprise means for releasably locking the reaction members in their other end positions.

The aforementioned portion of each pusher is movable relative to its key to and from a predetermined position, and each key preferably carries a leaf spring, a torsion spring or other suitable means for yieldably biasing the portion of the respective pusher to its predetermined position.

The novel features which are considered as characteristic of the invention are set forth in particular in the appended claims. The improved manual itself, however, both as to its construction and its mode of operation together with additional features and advantages thereof, will be best understood upon perusal of the following detailed description of certain specific embodiments with reference to the accompanying drawing.

DESCRIPTION OF THE PREFERRED EMBODIMENTS

Figure 1:
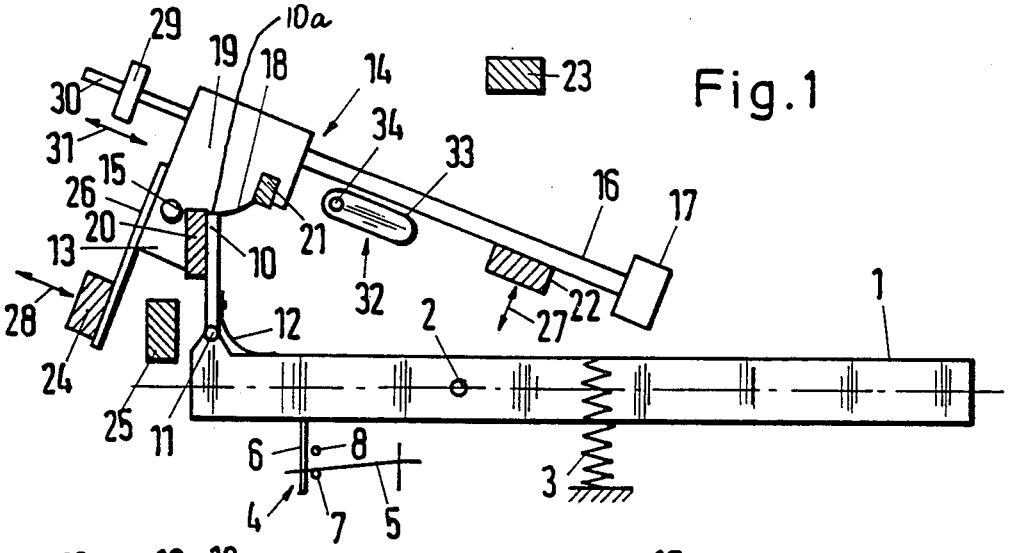
FIG. 1 is a schematic partly elevational and partly vertical sectional view of a portion of a manual for use in an electronic organ which is constructed and assembled in accordance with a first embodiment of the invention, the key being shown in its non-depressed position and the reaction lever for the key being shown in one of its end positions.
Figure 2:
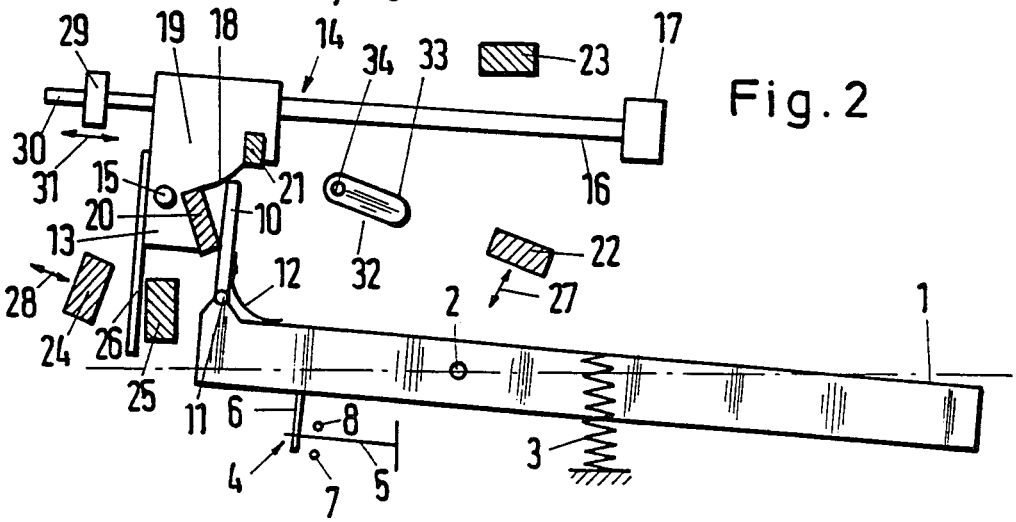
FIG. 2 shows the structure of FIG. 1 but with the key in a partly depressed position and with the reaction lever on its way from the one to the other end position.

FIGS. 1 to 4 show one action of a manual which embodies the invention and forms part of an electronic organ. The illustrated action comprises an elongated key 1 pivotable about a horizontal axis which is defined by a pivot member 2 mounted in the frame of the musical instrument. The key 1 is depressible from the position of FIG. 1, through the intermediate position of FIG. 2 and to the fully depressed position of FIGS. 3 and 4, and such depression of the key 1 is yieldably opposed by a coil spring 3. The underside of the key 1 carries an actuator 6 which causes or permits a movable contact 5 of an electric switch 4 to assume the position of FIG. 1 in non-depressed position of the key (at such time, the movable contact 5 engages a first fixed terminal 7). The contact 5 is disengaged from the terminal 7 and engages a second terminal 8 in response to movement of the key 1 to the fully depressed position of FIG. 3 or 4, and the contact 5 is disengaged from both terminals in the intermediate position of the key 1 (as shown in FIG. 2). The purpose of the switch 4 is well known to those familiar with the design of electronic organs.

The coil spring 3 reacts against the frame and bears against the right-hand arm of the key 1. The free end portion of the left-hand arm of the key 1 carries a pusher 10 which is articulately connected to the key by a horizontal pivot member 11 defining a pivot axis parallel to that of the pivot member 2. The pusher 10 is yieldably biased by a leaf spring 12 which is affixed thereto and reacts against the upper side of the key 1 to urge the pusher 10 to a predetermined position which is shown in FIG. 1 and in which the upper end face of the upper end portion or tip 10*a* of the pusher 10 abuts the adjacent portion of a convex cam face 18 provided on a relatively large and heavy reaction member in the form of a three-armed lever 14. The leaf spring 12 can be replaced with a torsion spring or with any other suitable spring (or even with a weight) which is capable of normally maintaining the left-hand side of the pusher 10 in full contact with a sound-absorbing cushion or pad 20 provided on the adjacent arm 13 of the reaction lever 14. The lower portion of the illustrated leaf spring 12 merely abuts the upper side of the respective arm of the key 1.

The reaction lever 14 is pivotable about the horizontal axis of a pivot member 15 which is parallel to the pivot members 2 and 11 and is flanked by the arm 13 as well as a longer arm 16 of the lever. The free end portion of the longer arm 16 carries a weight 17 which constitutes a means for yieldably biasing the lever 14 to the end position of FIG. 1 in which the arm 16 abuts a stop 22 in the form of or including a cushion or pad and in which an extension 26 of the arm 13 abuts a stop 24 which preferably also includes or constitutes a cushion or pad. The convex cam face 18 is provided on the lever 14 between its arms 13, 16 (actually on the arm 16) and the center of curvature 19 of the cam face 18 is located in or close to the plane of the pusher 10 when the lever 14 is caused to assume the end position of FIG. 1 under the action of the weight 17. The cam face 18 can form part of a cylindrical surface, and the end face of the tip 10*a* of the pusher 10 preferably coincides with a tangent to the cam face 18 in the region immediately adjacent the pad 20 on the arm 13 when the lever 14 is caused to assume the end position of FIG. 1. The pusher 10 can constitute a bar, a strip, a rod or a like body which is flanked by two parallel surfaces and wherein the upper end face of the tip 10*a* is or can be substantially horizontal in non-depressed position of the key 1 and in the first end position (FIG. 1) of the reaction lever 14.

The axis which is defined by the pivot member 15 for the reaction lever 14 is preferably located on or close to an imaginary leftward extension of the arcuate cam face 18, i.e., the distance between the axis which is defined by the pivot member 15 and the center of curvature 19 is preferably the same as that between any point of the cam face 18 and such center of curvature. One end of the cam face 18 is adjacent the cushion or pad 20 on the arm 13, and the other end of the cam face is adjacent a cushion or pad 21 which is recessed into the reaction lever 14 to be engaged by the upper end face of the tip 10*a* when the key 1 is fully or nearly fully depressed (FIG. 3) and the lever 14 assumes an intermediate position which is close to the second end position of FIG. 4. In the second end position, the longer arm 16 of the lever 14 abuts a stop 23 in the form of or including a cushion or pad which is installed in the frame of the musical instrument. That surface of the pad 20 which abuts the left-hand side of the pusher 10 in the first end position of the lever 14 (FIG. 1) is substantially coplanar with the center of curvature 19 of the cam face 18. The lower surface or underside of the cushion or pad 21 bypasses the center of curvature 19. and is substantially parallel to the longitudinal extension of the arm 16. The arrangement is preferably such that the right-hand surface of the pad 20 lies flush against the left-hand side of the pusher 10 in the first end position of the reaction lever 14.

The stops 22, 23 determine the extent of pivotability of the longer arm 16, and the stops 24, 25 determine the extent of pivotability of the arm 13 (actually of the extension 26 of the arm 13) of the lever 14. Each of the stops 22–25 can be made entirely of a soft and hence yieldable material, or each of these stops can constitute a rigid body which merely carries a relatively thin layer of cushioning material at that side which faces the arm 16 or the extension 26. In order to reduce the initial cost of the manual, the stops 22 for all of the reaction levers 14 can form part of a single elongated strip, and the same holds true for the stops 23, 24 and 25. Such strips extend in parallelism with the axes of pivot members 2, 11 and 15.

In order to compensate for manufacturing tolerances, and more particularly to ensure that the end face of the tip 10*a* of each pusher 10 will properly engage the adjacent portion of the respective cam face 18 in the first end position of the respective lever 14, the stop 22 and/or 24 is preferably adjustable in directions which are indicated by the corresponding double-headed arrows 27 and 28, namely along arcuate paths having their centers of curvature on the axis of the pivot member 15. The adjustment is preferably such that the reaction lever 14 is closely adjacent but need not actually contact the stops 22 and 24 when it is held in the end position of FIG. 1; at such time, the lever 14 is held against angular displacement from the first end position of FIG. 1 exclusively or primarily by the upper end face of the tip 10*a* of the pusher 10 while the key 1 is held in the nondepressed position under the bias of the coil spring 3. The center of gravity of the longer arm 16 of the reaction lever 14 is then located at or close to the level of the axis of the pivot member 15 so that the longer lever arm 16 tends to turn the lever 14 in a clockwise direction but such turning is opposed by friction between the upper end face of the tip 10*a* and the adjacent end portion of the cam face 18. In other words, the lever 14 tends to turn counter to the direction (counterclockwise) in which it is compelled to turn when the right-hand arm of the key 1 is depressed so that the coil spring 3 stores energy and the pusher 10 moves upwardly from the position of FIG. 1 toward the position of FIG. 2.

Figure 3:
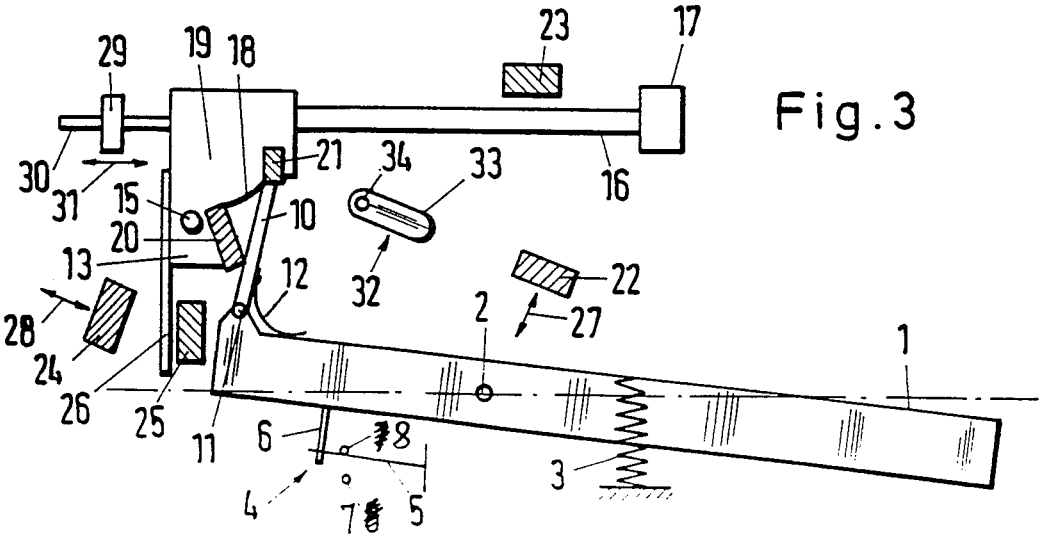
FIG. 3 shows the structure of FIG. 1 but with the key in fully depressed position and with the reaction lever in an intermediate position in which the upper end portion of the pusher on the key is engaged by a pad on the longer arm of the reaction lever.
Figure 4:
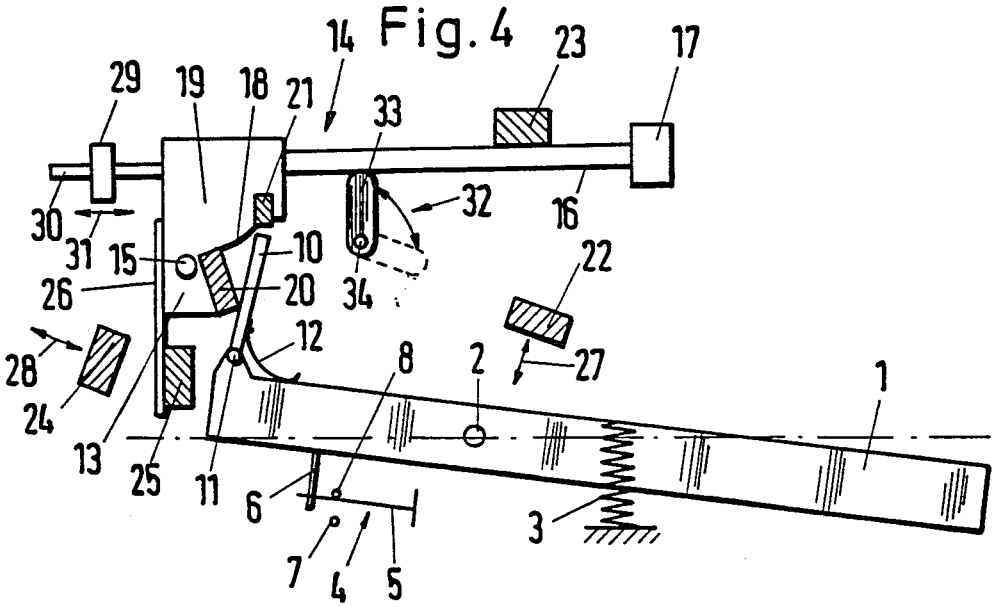
FIG. 4 illustrates the structure of FIG. 3 but with the reaction lever in the other end position.

In order to allow for regulation of the force with which the upper end face of the tip 10*a* of the pusher 10 bears against the adjacent end portion of the cam face 18, the action which is shown in FIGS. 1 to 4 further comprises means for yieldably urging the lever 14 to the end position of FIG. 4, and such urging means comprises a third arm 30 and a weight 29 which is adjustably mounted on the arm 30 so that it can change its distance from the axis of the pivot member 15. The arm 30 can constitute an externally threaded shank or stem, and the weight 29 can constitute a nut which can be rotated to thereby move toward or away from the arm 16. The latter is or can be at least substantially aligned with the third arm 30. The arms 16 and 30 are disposed at opposite sides of the pivot member 15. The directions in which the weight 29 is adjustable in the longitudinal direction of the arm 30 are indicated by a double-headed arrow 31. If desired, a cotter pin, a lock nut or other suitable retaining means can be provided to maintain the weight 29 in a selected position.

The action of FIGS. 1 to 4 further comprises means 32 for releasably locking the reaction lever 14 in the second end position of FIG. 4. The locking means 32 comprises a one-armed locking lever 33 which is pivotable about the axis of a horizontal pivot member 34 between an inoperative position which is shown in FIGS. 1–3 and an operative position which is shown in FIG. 4 by solid lines (the inoperative position of the lever 33 is shown in FIG. 4 by broken lines). The manual which embodies the action of FIGS. 1 to 4 can comprise a discrete locking lever 33 for each reaction lever 14 and such locking levers can be mounted on a common pivot member 34 in the form of an elongated shaft which extends beneath the entire row of arms 16. When the lever 33 assumes the operative position of FIG. 4, the cushion or pad 21 of the reaction lever 14 is remote from the tip 10*a* of the pusher 10 so that the latter cannot come in contact with the reaction lever. The piano effect is then nil so that the player of the musical instrument embodying the structure of FIG. 4 can depress the key 1 solely against the resistance of the coil spring 3. At such time, the locking lever 33 maintains the arm 16 of the reaction lever 14 in a position of abutment with the stop 23 and the extension 26 of the arm 13 abuts or can abut the stop 25.

The illustrated locking means 32 can be modified in a number of ways without departing from the spirit of the invention. For example, the locking means can comprise two spaced-apart levers 33 at the ends of the manual and a bar or rod which connects the two levers and engages the undersides of all arms 16 to maintain such arms in engagement with the respective stops 23 or with a common stop 23 in the operative positions of the two levers 33. Such levers are pivotable about a common axis which can be defined by two discrete pivot members 34 or by a shaft having end portions journalled in the frame of the musical instrument. The common shaft can be provided with a single handle or with a discrete handle at each of its ends to enable the player to pivot the two levers 33 and the bar or rod between such levers from the operative position to the inoperative position or vice versa. It is also possible to provide a motor (not shown) which is actuatable to jointly move all of the levers 33 between their operative and inoperative positions. For example, the motor can include an electromagnetic drive which can rotate a common shaft for two locking levers 33 at the ends of the manual. The motor can be started by pulling a drawbar or an analogous actuator which thereby closes an electric switch in the circuit of the motor.

When the locking means 32 is inoperative (i.e., when the lever 33 assumes the position which is shown in FIGS. 1 to 3) and the player depresses the key 1 against the opposition of the coil spring 3, the key pivots about the axis which is defined by the pivot member 2 and lifts the pusher 10 which immediately turns the reaction lever 14 in a counterclockwise direction (as seen in FIG. 1) with a relatively large force due to pronounced engagement between the upper end face of the tip 10*a* and the adjacent end portion of the cam face 18. The latter curves upwardly and away from the path of movement of the tip 10*a* from the position of FIG. 1 to the position of FIG. 3. During the initial stage of pivotal movement of the key 1 from its non-depressed position, the magnitude of reaction force which the lever 14 applies to the key 1 by way of the pusher 10 is directly proportional to acceleration of the key from its non-depressed position. The reaction force is relatively large because the distance between the center of gravity of the weight 17 and the axis of the pivot member 15 greatly exceeds the distance of the tip 10*a* from the pivot member 15. As can be seen in FIG. 1, the distance of the tip 10*a* from the pivot member 15 is a very small fraction of the distance of the center of gravity of the weight 17 from the pivot member 15. Such ratio of the just discussed distances renders it possible to employ a relatively small weight 17.

As the pusher 10 acts upon the cam face 18 to pivot the reaction lever 14 in a counterclockwise direction (as seen in FIG. 1), the pad 20 of the arm 13 bears against and pivots the pusher 10 relative to the key 1 against the opposition of the leaf spring 12 (the pusher 10 is pivoted at 11 in a clockwise direction). Such pivoting of the pusher 10 continues until the latter reaches a so-called release position which is shown in FIG. 2 and in which the upper end face of the tip 10*a* can slide relative to the cam face 18 due to the aforementioned inclination of the cam face relative to the path of movement of the tip 10*a* in response to depression of the key 1. The player can readily detect that the pusher 10 is then free to slide relative to the cam face 18 because the resistance with which the key 1 opposes depression then decreases, i.e., the key offers a greater resistance during the initial stage and a lesser resistance during the next following stage of depression from the position of FIG. 1.

The key 1 then continues to pivot toward its fully depressed position of FIG. 3 in which it strikes a stop (not shown), and the tip 10*a* of the pusher 10 travels along the cam face 18 without exerting a pronounced force to pivot the lever 14 in a counter clockwise direction. The cam face 18 actually moves or can move out of contact with the tip 10*a* of the pusher 10 as the reaction lever 14 continues to pivot due to inertia until its arms 16, 13 (26) respectively strike the stops 23, 25. The weight 17 then pivots the lever 14 clockwise from the position of FIG. 4 to the position of FIG. 3 in which the upper end face of the tip 10*a* of the pusher 10 is engaged by the underside of the pad 21. The lever 14 leaves the end position of FIG. 4 to assume the intermediate position of FIG. 3 partly under the action of the weight 17 and partly as a result of rebounding of its arms 16, 13 on impact against the respective stops 23 and 25. The intermediate position of the lever 14 which is shown in FIG. 3 is a so-called repetition position in which the player can repeatedly and rapidly depress the key 1.

In the embodiment which is shown in FIGS. 1 to 4, the pusher 10 is guided solely by the properly configurated reaction lever 14 and its cam face 18 so that one can dispense with a conventional release element which acts upon a discrete lever of the pusher. Thus, during movement between the cushion 20 of the arm 13 (26) and the cushion 21 of the arm 16, the pusher 10 is guided exclusively by the cam face 18 of the reaction lever 14. The pusher 10 performs the function of a conventional catcher and the arm 16 with its cushion 21 performs the function of a conventional complementary catcher.

By moving the weight 29 closer to the axis which is defined by the pivot member 15 for the reaction lever 14, the person in charge of adjusting the action of FIGS. 1 to 4 increases the effective mass of the weight 17 (i.e., of the lever portion to the right of the pivot member 15) to thus increase the stress of the lever 14 upon the pusher 10 in the position of FIG. 1. This, in turn, increases the resistance which the player encounters to depression of the key 1. The increased resistance can be readily noted by the player. The exact locus where the tip 10*a* of the pusher 10 begins to slide relative to the cam face 18 (in a direction to the right, as seen in FIG. 2) is noticed by the player even more readily if the initial resistance to depression of the key 1 is increased in the aforedescribed manner, namely by moving the weight 29 along the third arm 30 toward the axis of the pivot member 15 for the lever 14. Thus, the person in charge (such as a piano or organ tuner) can ensure that the touch of the improved manual conforms optimally to the touch of the keyboard in a standard piano or a like musical instrument.

Keyboard players often prefer so-called slanted key fronts, i.e., the placing of the musical instrument into an inclined position so that the righthand portion of each key 1 (as seen in FIGS. 1 to 4) is at a level above or well above the respective pivot member 2. This can be readily achieved if the manual is assembled from actions of the type shown in FIGS. 1–4 without in any way affecting the operation of the actions. The keys can be inclined up to and even beyond an angle of 40° to the horizontal.

An important advantage of the improved manual is that the initial stage of depression of the key 1 involves the application of the entire (or practically entire) depressing force to the relatively large and heavy reaction lever 14. This is due to the fact that the upper end face of the tip 10a of the pusher 10 is substantially tangential to the adjacent portion of the cam face 18 when the reaction lever 14 and the pusher 10 assume the positions of FIG. 1. Thus, the touch of the improved manual is the same as prescribed for classical piano actions (reference may be had to West German DIN Norm 8992 dated January 1971). The reaction lever 14 undergoes abrupt and very pronounced acceleration in response to initial depression of the key 1 because the distance of the tip 10*a* of the pusher 10 from the axis of the pivot member 15 is small and the distance of the center of gravity of the weight 17 on the arm 16 from the pivot member 15 is much larger. This, in turn, ensures that the lever 14 generates a large reaction force which is a product of the mass and acceleration of the reaction lever. All this can be accomplished with a relatively simple, compact and inexpensive action which merely comprises the pusher 10, the reaction lever 14 and the aforedescribed stops for the arms 13, 16 of the reaction lever. This is in contrast to the design of classical piano actions which comprise a larger number of parts and are much more complex in many additional respects. The mass of the weight 17 is or can be very small because this weight is located at a substantial distance from the axis of the pivot member 15 for the reaction lever 14.

Pivoting of the pusher 10 relative to the key 1 by the arm 13 of the reaction lever 14 is desirable and advantageous because this ensures that the pusher 10 becomes inclined relative to the adjacent portion of the cam face 18 (i.e., the pusher no longer extends radially of the cam face as can be readily seen in FIGS. 2 and 3) so that the tip 10a can readily slide along the cam face to thereby greatly reduce the resistance to further depression of the key 1. In FIG. 2, only a marginal portion of the upper end face of the tip 10*a* of the pusher 10 is in contact with the cam face 18, i.e., the upper end face of the tip 10*a* is no longer tangential to the adjacent portion of the cam face. At such time, only a relatively small component of the force which is applied to depress the key 1 is still used to pivot the reaction lever 14 in a counterclockwise direction. The resistance which the key 1 encounters to further depression decreases abruptly when the tip 10*a* of the pusher 10 becomes completely disengaged from the cam face 18. Such mode of operation of the improved manual closely resembles that of keyboards in standard pianos. This renders it possible to employ a pusher in the form of a simple rod or bar without an additional lever as is customary in connection with pusher tongues of standard piano actions It is also possible to dispense with the release element of the standard piano action which is to be engaged by the lever of the pusher tongue; this is due to the fact that the arm 16 of the reaction lever 14 performs the releasing action.

The tuner of the musical instrument which employs the improved manual will change the distance of the weight 29 from the axis of the pivot member 15 for the reaction lever 14 whenever such person desires to ensure that the player will even more readily detect or sense the reduction of resistance which the key 1 offers to movement from its undepressed position when the tip 10*a* of the pusher 10 begins to slide along the cam face 18. Thus, the initial resistance to depression of the key 1 is increased by moving the weight 29 nearer to the pivot member 15; this automatically ensures that the difference between the initial resistance and the resistance to further depression of the key 1 is increased and that a piano player who prefers or is accustomed to such pronounced difference between the resistances to initial and next-following stages of depression of the key 1 requires even less time to become accustomed to the playing of an organ. In other words, by the simple expedient of adjusting the distance of the weight 29 from the pivot member 15, the tuner can ensure that the releasing action of the pusher 10 closely resembles or actually matches that of the pusher tongue in a standard piano action.

The cushion or pad 21 constitutes an optional but highly desirable and advantageous feature of the improved manual. This cushion enables the pusher 10 to perform the function of the catcher in a standard piano action and the arm 13 can perform the function of the complementary catcher without the need for a discrete complementary catcher handle or bar on the reaction lever. When in the position of FIG. 3, in which the tip 10*a* of the pusher 10 contacts the underside of the cushion or pad 21, the lever 14 renders it possible to allow for rapid repetition of the sound, for example, to produce a tremolo effect.

It is desirable to make the lever portion next to the cam face 18 and/or the tip 10*a* of the pusher 10 of a material which has a low coefficient of friction so that the tip 10*a* can readily slide along the cam face 18 when such sliding movement is desired. This ensures that the piano effect is not affected by friction between the cam face 18 and the tip 10*a*. The provision of a cushion on the cam face 18 and/or on the tip 10*a* of the pusher 10 is often desirable and advantageous in order to reduce noise when the improved manual is in use.

The adjustability of stop 22 and/or 24 (arrows 27, 28) is an optional but desirable feature of the improved manual. Such adjustability renders it possible to compensate for manufacturing tolerances. Cushioning of the stop 22 and 24 renders it possible to reduce noise in actual use of the manual.

Figure 5:
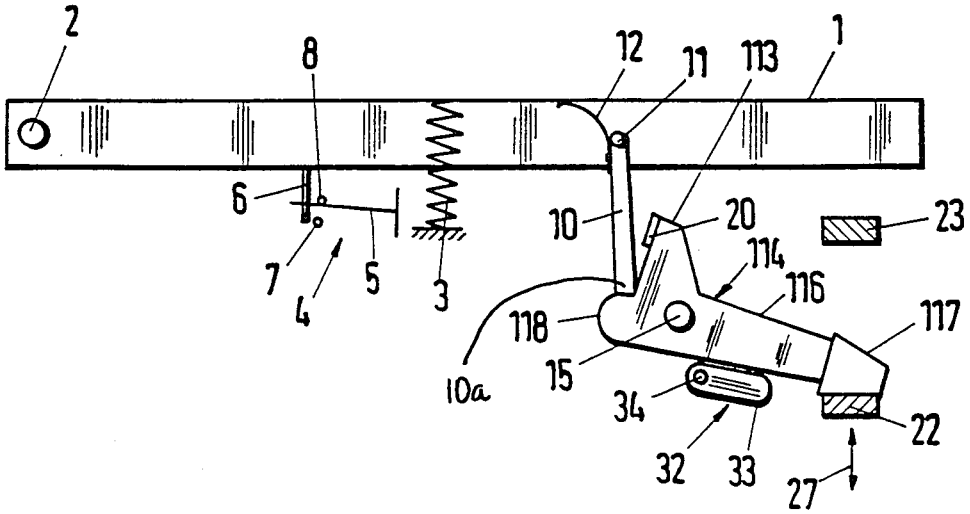
FIG. 5 is a partly elevational and partly vertical sectional view of a portion of a modified manual wherein the reaction lever is installed at a level beneath the corresponding key, the key being shown in the non-depressed position and the reaction lever being shown in one of its end positions.
Figure 6:
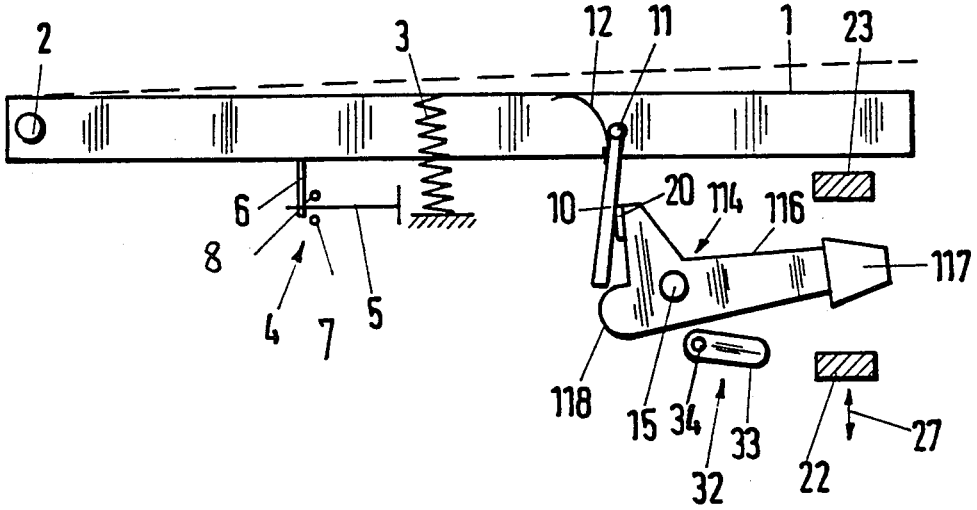
FIG. 6 shows the structure of FIG. 5 but with the key in a partly depressed position and with the reaction lever on its way toward the other end position.
Figure 7:
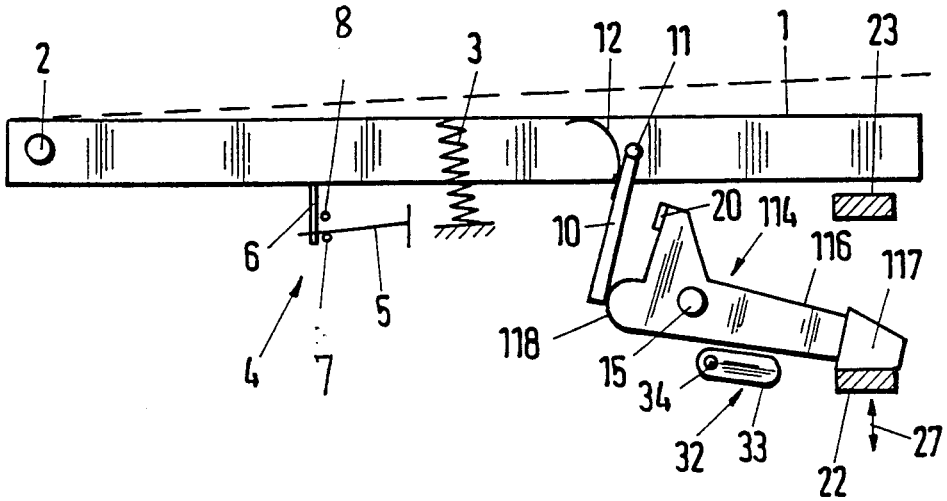
FIG. 7 illustrates the structure of FIGS. 5 and 6, with the key in fully depressed position and with the reaction lever in the other end position.

FIGS. 5 to 7 show the action of a modified manual wherein the reaction lever 114 is located at a level below the key 1. The pivot member 2 is located at the left-hand end of the key 1 and the coil spring 3 acts in the region between the pivot member 2 and the pivot member 11 for the upper end portion of the pusher 10. The lower end portion or tip 10*a* of the pusher 10 cooperates with a convex cam face 118 of the reaction lever 114. Furthermore, the cam face 118 and the weight 117 are disposed at opposite sides of the pivot member 15 for the reaction lever 114, i.e., the cam face 118 is provided on the arm 113 (rather than on the arm 116) of the reaction lever of FIGS. 5 to 7.

The mode of operation of the action of FIGS. 5 to 7 is analogous to that of the action which is shown in FIGS. 1 to 4. Thus, when the key 1 is depressed to cover approximately 70% of its path between the non-depressed and fully depressed positions, the pusher 10 and the reaction lever 114 assume the positions which are shown in FIG. 6. The inclination of the pusher 10 relative to the key 1 has been changed by the cushion or pad 20 of the arm 113 so that the pusher 10 and the lever 114 assume their release positions in which the resistance to further depression of the key 1 against the opposition of the coil spring 3 and the opposition of the lever 114 is much less than the resistance to the initial stage of depression of the key. The tip 10*a* of the pusher 10 thereupon slips in response to further depression of the key 1 toward the position of FIG. 7 because the curvature of the cam face 118 is such that the cam face slopes away from the path of movement of the tip 10*a* toward the position of FIG. 7. In other words, the pusher 10 ceases to pivot the reaction lever 114 in a counterclockwise direction so that the key 1 must merely overcome the resistance of the coil spring 3 during the next following stage of its pivotal movement (from the intermediate position of FIG. 6 to the fully depressed position of FIG. 7). The inertia of the reaction lever 114 causes the latter to continue its pivotal movement in a counterclockwise direction so that the arm 116 rebounds on impact against the elastic portion of the upper stop 23 and the weight 117 is thereupon free to pivot the lever 114 clockwise back to the end position of FIG. 5 in which the arm 116 comes to rest on or is closely adjacent the elastic cushion of the stop 22. When the pressure upon the right-hand portion of the key 1 is relaxed, the spring 3 is free to expand and returns the key and the pusher 10 to the positions of FIG. 5. The lower end position (i.e., the fully depressed position) of the key 1 is determined by a suitable stop which is not shown in FIGS. 5 to 7.

The arm 113 of the reaction lever 114 preferably carries an adjustable weight (not shown) which performs the function of the weight 29 of FIGS. 1–4, i.e., the operator in charge can adjust the force with which the tip 10*a* of the pusher 10 is acted upon by the respective end portion of the cam face 118 in the corresponding end position of the reaction lever 114 (as shown in FIG. 5). Moreover, the operator in charge can eliminate play between the pusher 10 and the cam face 118 by changing the level of the stop 22 in one of the directions which are indicated by a double-headed arrow 27.

The locking means 32 (including the lever 33 and the pivot member 34) is or can be identical with the locking means 32 of the embodiment, which is shown in FIGS. 1 to 4. The locking means will be caused to assume its operative position (in which the arm 116 of the reaction lever 114 abuts or is immediately adjacent the upper stop 23) when the user of the manual including the action of FIGS. 5 to 7 wishes to depart from operation with piano effect, i.e., when the key 1 should be movable to depressed position solely against the opposition of the coil spring 3.

The embodiment of FIGS. 5 to 7 also allows for an inclination of the manual so that the keys 1 of the manual are inclined with respect to the horizontal by up to and even in excess of 40° without affecting the operation of the action.

Figure 8:
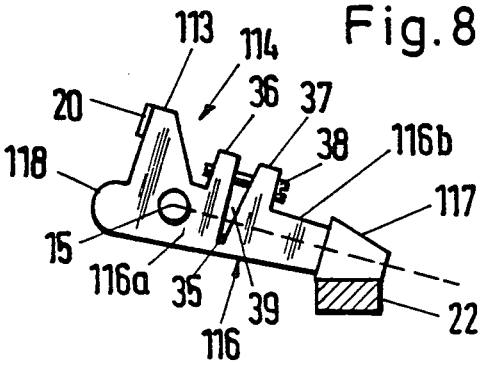
FIG. 8 is an elevational view of a modified reaction lever wherein one arm of the lever has two sections which are articulately connected to each other by a rudimentary hinge.
Figure 9:
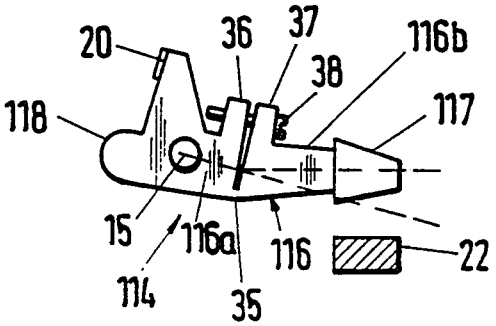
FIG. 9 shows the structure of FIG. 8 but with the sections of the one arm in different angular positions relative to each other.

FIGS. 8 and 9 show a third reaction lever (again denoted by the character 114 because it is designed for use at a level below the respective key 1 in the same way as shown in FIGS. 5 to 7) which has a modified elongated arm 116 composed of sections 116*a*, 116*b* articulately connected to each other by a simple hinge 35 so that the section 116*b* (which carries the weight 117) is pivotable relative to the section 116*a* about an axis which is parallel to the axis of the pivot member 15 for the reaction lever 114. The illustrated hinge 35 is a simple flexible web which is integral with the adjacent socket-like portions or projections 36, 37 of the sections 116*a*, 116*b*. The portions 36, 37 extend transversely of the longitudinal direction of the arm 116 and the portion 36 has a tapped bore (not specifically shown) which receives the externally threaded portion or shank of an arresting member in the form of a screw 38 which extends through an untapped bore of the portion 37 and has a head abutting the right-hand side of the portion 37. The weight 117 tends to pivot the section **116*b* clockwise with reference to the section 116*a*, and the extent of such clockwise pivoting of the section 116*b* is controlled by the head of the arresting screw 38. The section 116*b* is pivoted counterclockwise with reference to the section 116*a* in response to rotation of the arresting screw 38 in a direction to narrow the wedge-like gap 39 between the portions 36, 37. The gap 39 is wider in FIG. 8 than in FIG. 9. The arresting screw 38 will be rotated to eliminate play between the pusher 10 (not shown in FIGS. 8 and 9) and the cam face 118 of the reaction lever 114 of FIGS. 8 and 9 because the operator can select that angular position in which the weight 117 on the section 116*b* can come to rest on the cushion of the stop 22. Thus, if the width of the gap 39 is reduced, the cam face 118 bears against the tip of the pusher before the weight 117 descends to a level which is required to ensure the establishment of actual contact between this weight and the stop 22. The manual which employs reaction levers 114 of the type shown in FIGS. 8 and 9 can dispense with means for adjusting the level of the stop 22**.

Figure 10:
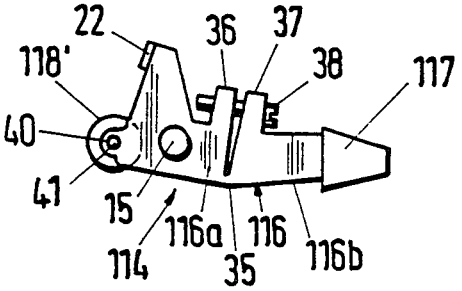
FIG. 10 is an elevational view of a reaction lever which constitutes a modification of the reaction lever of FIGS. 8 and 9.

FIG. 10 shows a reaction lever 114 which constitutes a modification of the reaction lever of FIGS. 8 and 9. The only difference is that the cam face 118' is constituted by the peripheral surface of an idler roller whose shaft 40 is journalled in two spaced-apart bearing lugs 41 (only one shown) of the respective arm of the lever 114. This ensures that the frictional engagement between the peripheral surface 118' of the roller and the end face of the tip of the pusher 10 (not shown in FIG. 10) is reduced to a minimum, at least when the pusher is to slip relative to the reaction lever 114.

The idler roller can be provided on the tip of the pusher 10 so that such idler roller rolls along the cam face 18 of the reaction lever 14 of FIGS. 1–4 or along the cam face 118 of the reaction lever 114 of FIGS. 5–7 or 8–9. An advantage of the idler roller (on the reaction lever 114 as shown in FIG. 10 or on the tip of the pusher 10) is that it is not necessary to lubricate the cam face 18, 118 or 118'. As a rule, some lubrication of the cam face 18 in FIGS. 1–4 or of the cam face 118 in FIGS. 5–9 is desirable and advantageous. In many instances, the cam face 18, 118 or 118' and/or the end face of the tip **10*a* of the pusher 10 is or can be provided on a layer of yieldable cushioning or elastic material such as rubber, silicone rubber or the like, in order to reduce noise when the manual employing the improved actions is in use. If the cam face 18, 118 or 118' and/or the end face of the tip 10*a* of the pusher 10** is merely padded, it is normally or often desirable and advantageous to employ a suitable lubricant because the friction coefficient of padding is normally high.

The provision of a roller-shaped component between the pusher and the reaction lever renders it possible to dispense with lubrication of the cam face so that the manual requires a minimum of maintenance because lubrication of the cam face with an oil or grease can be dispensed with. Moreover, many types of padding and/or elastic material are likely to be adversely affected by a lubricant, especially if the lubricant is not an optimum lubricant for the particular elastic or padding material. The roller having the cam face 118' renders it possible to dispense with lubrication as well as to select at will the padding or elastic material of the cam face and/or of the end face on the tip 10a of the pusher 10.

The improved manual is susceptible of many additional modifications. For example, and as already mentioned above, the relatively weak leaf spring 12 for the pusher 10 can be replaced with a torsion spring or with any other suitable spring. Alternatively, the pusher 10 can constitute an integral part of the key 1, as long as its tip **10*a* is movable relative to the main body of the key under the action of the arm 13 or 113 of the respective reaction lever 14 or 114. For example, the pusher 10 can be made of an elastomeric material and can be glued or otherwise bonded to the key 1**.

Furthermore, the weight 29 of FIGS. 1–4 can be mounted directly on the arm 13 so that it is movable toward and away from the axis of the pivot member 15 for the reaction lever 14. This renders it possible to dispense with the third arm 30. Analogously, the weight 29 can be mounted directly on the arm 113 of the reaction lever 114.

The weight 29 can be omitted if the weight 17 or 117 is adjustable in the longitudinal direction of the respective arm 16 or 116. This contributes to additional simplification of the reaction lever.

The extension 26 of FIGS. 1–4 can constitute an integral tongue or prong of the arm 13.

The simple web-like hinge 35 of FIGS. 8–10 can be replaced with a standard hinge having a pintle and two leaves connected to the sections **116*a*, 116*b* of the reaction lever 114. The pintle of such standard hinge can be provided with an external thread to take a nut which replaces the arresting screw 38 and the portions 36, 37. Thus, the nut can act upon the eyelets of the leaves on the pintle to hold such leaves against angular movement relative to each other so that the width of the gap 39** can be fixed by the simple expedient of tightening the nut.

Last but not least, the weight 29 can be omitted and the weight 17 or 117 need not be adjustable in the longitudinal direction of the arm 16 or 116 if the effective length of the pusher 10 is adjustable. For example, the pusher 10 can include a first section which is pivotable on the key 1 at 11 and a second section which carries the tip 10a and is movable relative to the first section so as to eliminate eventual play between the tip **10*a* and the cam face 18, 118 or 118'**. The two sections of the pusher can be provided with mating male and female threaded portions so that rotation of one of the sections relative to the other section entails a lengthening or shortening of the composite pusher.

As used herein, the term "electronic organs" is intended to embrace electronic pianos and so-called keyboards.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A manual with piano effect for use in electronic organs and analogous musical instruments, comprising a key which is depressible to thereby pivot about a first axis; a reaction member adjacent said key and pivotable about a second axis between first and second end positions, said member having a first arm, a second arm, an arcuate cam face, and means for biasing said member to one of said end positions; and means for pivoting said member from said one end position toward the other of said end positions in response to depression of said key, including a pusher pivotable with and movable relative to said key and having a portion in frictional engagement with said cam face in the one end position of said member and in undepressed position of said key, said portion of said pusher being located at a first distance and said biasing means being located at a greater second distance from said second axis in the one end position of said member, said portion of said pusher being arranged to move along a predetermined path in response to depression of said key so as to pivot said member from the one end position during depression of said key, said cam face being designed in such a manner that, during depression of said key, the frictional force between said portion of said pusher and said cam face abruptly decreases in a preselected release position of said portion of said pusher and a preselected intermediate position of said member, one of said arms being arranged to move said portion of said pusher relative to said key and into said release position in response to depression of said key.

2. The manual of claim 1, wherein said biasing means comprises a weight provided on the other of said arms and having a center of gravity, said first distance being a small fraction of the distance of said center of gravity from said second axis, and said weight having a mass such that, upon depression of said key and resulting acceleration of said weight, the latter produces a reaction force resembling that produced in a piano.

3. The manual of claim 1, wherein said one arm abuts said pusher in the one end position of said member.

4. The manual of claim 1, further comprising means for pivotally connecting said pusher to said key so that the pusher is pivotable about a third axis.

5. The manual of claim 4, wherein said axes are substantially parallel to each other.

6. The manual of claim 1, further comprising means for yieldably urging said member toward said other end position with a variable force and against the opposition of said biasing means.

7. The manual of claim 6, wherein said biasing means comprises a first weight on the other of said arms and said urging means comprises a third arm on said member and a second weight mounted on said third arm for movement between a plurality of positions at different distances from said second axis.

8. The manual of claim 1, wherein the other of said arms includes a cushion and said portion of said pusher is designed to engage said cushion in a second intermediate position of said member close to said other end position so as to confine said member to movement between said second intermediate and other end positions.

9. The manual of claim 1, wherein said portion of said pusher has a face which engages the cam face in the one end position of said member, at least one of said faces having a low coefficient of friction.

10. The manual of claim 1, wherein said portion of said pusher has a face in contact with said cam face in the one end position of said member, one of said faces constituting the annular peripheral surface of a roller.

11. The manual of claim 1, wherein said portion of said pusher has a face in contact with said cam face in the one end position of said member, at least one of the parts including said member and said pusher having a cushion defining the respective face.

12. The manual of claim 1, further comprising first and second cushions against which said member abuts in the first and second end positions thereof, at least one of said cushions being adjustable to thereby alter the extent of movability of said member between the first and second end positions thereof.

13. The manual of claim 12, wherein said member abuts said one cushion in the one end position thereof.

14. The manual of claim 1, wherein the other of said arms includes first and second sections and means for articulately connecting said sections to each other.

15. The manual of claim 14, wherein said connecting means comprises a hinge defining a third axis which is substantially parallel to said first and second axes.

16. The manual of claim 15, wherein said first section is rigid with said one arm and said second section is pivotable relative to said first section about said third axis, said biasing means being provided on said second section.

17. The manual of claim 14, wherein one of said sections is movable relative to the other of said sections between a plurality of different positions; and further comprising means for arresting said one section in a selected position with reference to said other section.

18. The manual of claim 14, wherein said connecting means comprises a flexible web integral with said sections and defining a third axis which is substantially parallel with said first and second axes, said sections having projections adjacent said web, one of said sections being pivotable relative to the other of said sections about said third axis between a plurality of different positions; and further comprising means for arresting the one section in a selected position relative to said other section, said arresting means comprising a threaded fastener arranged to maintain said projections in selected positions relative to each other.

19. The manual of claim 18, wherein said other arm is elongated and said projections extend transversely of said other arm.

20. The manual of claim 1, further comprising means for releasably locking said member in said other end position.

21. The manual of claim 1, wherein said portion of said pusher is movable relative to said key to and from a predetermined position; and further comprising means for yieldably biasing said portion of said pusher to said predetermined position.

22. The manual of claim 1, wherein said axes one is substantially horizontal.

23. A manual with piano effect for use in electronic organs and analogous musical instruments, comprising a key which is depressible to thereby pivot about a first substantially horizontal axis; a reaction member adjacent said key and pivotable about a second axis between first and second end positions, said member having a first arm, a second arm, an arcuate cam face, and means for biasing said member to one of said end positions; means for pivoting said member from said one end position toward the other of said end positions in response to depression of said key, including a pusher pivotable with and movable relative to said key and having a portion in frictional engagement with said cam face in the one end position of said member and in undepressed position of said key, said portion of said pusher being located at a first distance from said second axis in the one end position of said member and being arranged to move along a predetermined path in response to depression of said key so as to pivot said member from the one end position during depression of said key, said cam face being designed in such a manner that, during depression of said key, the frictional force between said portion of said pusher and said cam face abruptly decreases in a preselected release position of said portion of said pusher and a preselected intermediate position of said member, one of said arms being arranged to move said portion of said pusher relative to said key and into said release position in response to depression of said key, said biasing means comprising a weight on the other of said arms having a center of gravity located at a second distance from said second axis in the one end position of said member, said first distance being a small fraction of said second distance, said weight having a mass such that, upon depression of said key and resulting acceleration of said weight, the latter produces a reaction force resembling that produced in a piano; and means for releasably locking said member in said other end position.

24. A manual with piano effect for use in electronic organs and analogous musical instruments, comprising a key which is depressible to thereby pivot about a first substantially horizontal axis; a reaction member adjacent said key and pivotable about a second axis between said first and second end positions, said member having a first arm, a second arm, an arcuate cam face, and means for biasing said member to one of said end positions; means for pivoting said member from said one end position toward the other of said end positions in response to depression of said key, including a pusher pivotable with and movable relative to said key and having a portion in frictional engagement with said cam face in the one end position of said member and in undepressed position of said key, said portion of said pusher being located at a first distance from said second axis in the one end position of said member and being arranged to move along a predetermined path in response to depression of said key so as to pivot said member from the one end position during depression of said key, said cam face being designed in such a manner that, during depression of said key, the frictional force between said portion of said pusher and said cam face abruptly decreases in a preselected release position of said portion of said pusher and a preselected intermediate position of said member, one of said arms being arranged to move said portion of said pusher relative to said key and into said release position in response to depression of said key, said biasing means comprising a weight on the other of said arms having a center of gravity located at a second distance from said second axis in the one end position of said member, said first distance being a small fraction of said second distance, said weight having a mass such that, upon depression of said key and resulting acceleration of said weight, the latter produces a reaction force resembling that produced in a piano, said portion of said pusher being designed to engage a selected section of said other arm in a second intermediate position of said member close to said other end position so as to confine said member to movement between said second intermediate and other end positions; and means for releasably locking said member in said other end position.

* * * * *